US008636146B2

(12) United States Patent
Coulter et al.

(10) Patent No.: US 8,636,146 B2
(45) Date of Patent: Jan. 28, 2014

(54) NAVIGATION SYSTEM

(75) Inventors: Keegan G. K. Coulter, Appleton, WI (US); Heidi Ellen Vanden Boom, Appleton, WI (US); Dayton Joel Henderson, Appleton, WI (US); Robert Eric MacDonald, Kohler, WI (US); Brenda Marie Nelson, Appleton, WI (US); Nicole Minotti, Appleton, WI (US); Laura Leigh Boudrie, Appleton, WI (US); Michael Patrick McCuskey, Northbrook, IL (US); Christine Marie Mau, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 891 days.

(21) Appl. No.: 12/718,953

(22) Filed: Mar. 6, 2010

(65) Prior Publication Data

US 2011/0215017 A1 Sep. 8, 2011

(51) Int. Cl.
*A61L 15/00* (2006.01)

(52) U.S. Cl.
USPC ..... 206/440; 206/459.5

(58) Field of Classification Search
USPC ..... 206/459.5, 281, 459.1, 440, 438, 494, 206/216, 223, 581, 38, 457, 812, 823; 40/312
See application file for complete search history.

(56) References Cited

U.S. PATENT DOCUMENTS 3,003,388 A 10/1961 Hunter et al.
4,798,603 A 1/1989 Meyer et al.
5,176,668 A 1/1993 Bernardin
5,192,606 A 3/1993 Proxmire et al.
5,350,624 A 9/1994 Georger et al.
5,509,915 A 4/1996 Hanson et al.
5,599,338 A 2/1997 Enloe
5,745,922 A 5/1998 Rajala et al.
6,028,018 A 2/2000 Amundson et al.
6,125,374 A * 9/2000 Terry et al. ..... 715/234

(Continued)

FOREIGN PATENT DOCUMENTS

CA 2 634 134 A1 6/2002
CA 2 599 561 A1 9/2006

(Continued)

OTHER PUBLICATIONS

Holben, Jay, "DV101: Eye of the Fresnel," Internet web page "http://www.dv.com/article/82460", May 5, 2009, pp. 1-3.

(Continued)

*Primary Examiner* — Jacob K Ackun
*Assistant Examiner* — Jenine Pagan
(74) *Attorney, Agent, or Firm* — Kimberly-Clark Worldwide, Inc.

(57) ABSTRACT

An array of personal care product packages comprises a first package containing a first personal care product and a second package containing a second personal care product. The first package and the second package are each of a single primary brand. The first package is of a first sub-brand and the second package is of a second sub-brand that is different than the first sub-brand. Each package further includes a visual schema, where the visual schema comprises a primary viewing area. The primary viewing area includes a product identification region comprising product identification indicia, a qualitative information region comprising qualitative information indicia, and a photographic region comprising photographic indicia. In addition, the visual schema is repeated for the first package and the second package.

4 Claims, 12 Drawing Sheets

(56) References Cited

U.S. PATENT DOCUMENTS

| | | | |
|---|---|---|---|
| 6,568,530 | B2 | 5/2003 | Takahashi et al. |
| 6,604,609 | B2 | 8/2003 | Bruce et al. |
| 6,626,881 | B2 | 9/2003 | Shingu et al. |
| 6,648,864 | B2 | 11/2003 | Ronn et al. |
| 6,685,020 | B2 | 2/2004 | Briseboi et al. |
| 6,763,944 | B2 | 7/2004 | Ronn et al. |
| D496,275 | S | 9/2004 | Hamuro et al. |
| D526,194 | S | 8/2006 | Hamuro et al. |
| 7,211,071 | B2 | 5/2007 | Mishima et |
| 7,222,732 | B2 | 5/2007 | Ronn et al. |
| 7,427,277 | B2 | 9/2008 | Woltman et al. |
| D581,265 | S | 11/2008 | Rochel |
| D587,111 | S | 2/2009 | Seol et al. |
| D590,250 | S | 4/2009 | Seol |
| D594,741 | S | 6/2009 | Bracey |
| 7,549,538 | B2 | 6/2009 | Naoe et al. |
| 7,572,249 | B2 | 8/2009 | Betts |
| 7,582,075 | B2 | 9/2009 | Betts et al. |
| D612,234 | S | 3/2010 | Westemeyer |
| D621,702 | S | 8/2010 | Tekulve et al. |
| D623,057 | S | 9/2010 | Kletz |
| 2005/0059942 | A1 | 3/2005 | Krautkramer et al. |
| 2006/0069372 | A1 | 3/2006 | Chakravarty et al. |
| 2006/0193898 | A1 | 8/2006 | Norman |
| 2007/0012519 | A1 | 1/2007 | Angielski |
| 2007/0095705 | A1 | 5/2007 | Legault et al. |
| 2007/0095706 | A1 | 5/2007 | Legault et al. |
| 2007/0144937 | A1 | 6/2007 | Gilroy |
| 2007/0151182 | A1 | 7/2007 | Ronn et al. |
| 2007/0235263 | A1 | 10/2007 | Legault et al. |
| 2007/0251851 | A1 | 11/2007 | Warren et al. |
| 2008/0051750 | A1 | 2/2008 | Schagen et al. |
| 2008/0053857 | A1 | 3/2008 | Albano et al. |
| 2008/0082070 | A1 | 4/2008 | Fell et al. |
| 2008/0087569 | A1 | 4/2008 | Ponomarenko et al. |
| 2008/0110782 | A1 | 5/2008 | Burgdorf et al. |
| 2008/0110783 | A1 | 5/2008 | Burgdorf et al. |
| 2008/0128307 | A1 | 6/2008 | Betts et al. |
| 2008/0128308 | A1* | 6/2008 | Betts ..... 206/440 |
| 2008/0250681 | A1 | 10/2008 | Jackson |
| 2008/0264824 | A1 | 10/2008 | Alejandra |
| 2008/0277295 | A1 | 11/2008 | Benson et al. |
| 2009/0054864 | A1 | 2/2009 | Lira et al. |
| 2009/0120825 | A1* | 5/2009 | Ruman et al. ..... 206/440 |
| 2009/0204090 | A1 | 8/2009 | Dennis et al. |
| 2009/0261009 | A1 | 10/2009 | Betts |
| 2009/0266733 | A1 | 10/2009 | Betts et al. |
| 2010/0018099 | A1 | 1/2010 | Lang et al. |
| 2010/0072108 | A1 | 3/2010 | Underhill et al. |
| 2010/0122929 | A1* | 5/2010 | McIver et al. ..... 206/459.5 |
| 2010/0193386 | A1* | 8/2010 | Loyd et al. ..... 206/438 |

FOREIGN PATENT DOCUMENTS

| | | | |
|---|---|---|---|
| CA | 2 627 633 | A1 | 5/2007 |
| CA | 2 651 074 | A1 | 11/2007 |
| CA | 2 598 907 | A1 | 2/2008 |
| CA | 2 667 034 | A1 | 4/2008 |
| CA | 2 346 204 | C | 8/2008 |
| CA | 2 429 757 | C | 4/2009 |
| CA | 2 347 288 | C | 7/2009 |
| DE | 10 2007 040 244 | A1 | 2/2009 |
| WO | WO 2009/147905 | A1 | 12/2009 |

OTHER PUBLICATIONS

Hunter, Richard S., "Photoelectric Color Difference Meter," *Journal of the Optical Society of America*, vol. 48, No. 12, American Institute of Physics Inc., Dec. 1958, pp. 985-995.

MamyPoko products, Internet web page "http://www.mamypokoclub.com/Menu_Console/Content_Management/frmContentRender.aspx?PageID=44", 2008, pp. 1-2.

* cited by examiner

NAVIGATION SYSTEM

BACKGROUND

"Personal care products" are generally known in the art as products of a personal hygiene or health care nature. Personal care products such as diapers, training pants, incontinence garments, feminine hygiene products, etc. often, although not necessarily, comprise a liquid permeable body-facing liner, a liquid impermeable outer cover, and/or an absorbent core formed separate from the outer cover and liner and disposed therebetween for taking in and retaining liquid (e.g., urine, menses) exuded by the wearer.

Some non-limiting examples of personal care products are described in U.S. Pat. No. 4,798,603 to Meyer et al.; U.S. Pat. No. 5,176,668 to Bernardin; U.S. Pat. No. 5,192,606 to Proxmire et al.; U.S. Pat. No. 5,350,624 to Georger et al.; U.S. Pat. No. 5,509,915 to Hanson et al.; U.S. Pat. No. 5,599,338 to Enloe; U.S. Pat. No. 5,745,922 to Rajala et al.; U.S. Pat. No. 6,028,018 to Amundson et al.; U.S. Pat. No. 7,427,277 to Georger et al.; and U.S. Patent Publication No. 2005/0059942 to Krautkramer et al.; U.S. Patent Publication No. 2009/0054864 to Lira et al.; and U.S. Patent Publication No. 2009/0204090 to Dennis et al.

Personal care products are typically placed in a package prior to being offered to a consumer. The package often has a primary viewing area which is displayed to a consumer and which includes any number of visual elements imparted onto the viewing area of the package in a variety of arrangements in an attempt to convey various features and properties of the products disposed therein. The package may be part of an overall primary brand line which includes additional packages, each containing variants of a particular product, or different products altogether. Each package of the primary brand typically has its own unique visual elements and arrangements to provide distinction between products, product tier levels or even product sub-brands. However, it has been found that many consumers today are confused and overwhelmed at the retail shelf when trying to locate a particular product forms from among many different product forms, even when the product form are of a single primary brand. This problem is further complicated by inconsistencies in the visual schema for each package. As such, consumers are unable to quickly navigate the retail shelf to locate the desired product. For example, package viewing area components, such as the current graphics utilized, the placement of such graphics, the fonts and font sizes utilized, the colors utilized, and the general arrangement of such components can make sub-brand distinction, tier distinction, product benefits and the ability for a consumer to choose the right product to match a user's need, making the shopping experience confusing and unclear. In addition, there are many visual and verbal inconsistencies across particular primary brand lines that do not add value, making the brand even more difficult to shop.

Thus, there is a need for a navigation system that equips a consumer with the ability to quickly navigate the retail shelf to locate a desired product. There is also a need for a visual schema within a primary brand that provides clearer and less confusing product, sub-brand and/or tier distinction. There is a further need for a system that equips a consumer with the ability to choose the right product to match a user's development stage. There is also a further need for a system that more clearly conveys the benefits of the products disposed within a corresponding package.

SUMMARY

In response to the needs discussed above, an array of personal care product packages is disclosed. The array comprises a first package containing at least one first personal care product and a second package containing at least one second personal care product. The first package and the second package are each of a single primary brand. The first package is of a first sub-brand and the second package is of a second sub-brand that is different than the first sub-brand. Each package further includes a visual schema, where the visual schema comprises a primary viewing area, the primary viewing area having a top edge, an opposing bottom edge, two opposing side edges located perpendicularly between the top edge and the bottom edge, a product identification region proximate the top edge comprising product identification indicia, a qualitative information region proximate one side edge comprising qualitative information indicia, and a photographic region proximate the opposing side edge comprising photographic indicia. In addition, the visual schema is repeated for the first package and the second package.

In some further aspects, the personal care product of the first sub-brand is a diaper and the personal care product of the second sub-brand is of a different product category. In other further aspects, the first sub-brand relates to a first tier level and the second sub-brand relates to a second tier level, where the first tier level and the second tier level are different.

In some further aspects, the product identification region is located in the upper third of the viewing area. In other further aspects, the product identification region extends from one side edge to the opposing side edge, where the product identification region comprises a top border that is proximate the top edge of the primary viewing area. In still other further aspects, the product identification region has a generally plano-convex shape, where the product identification region comprises a bottom border that is convexly curvilinear.

In some further aspects, the product identification region comprises a first dominant background color, where the first dominant background color of the first package and the first dominant background color of the second package are the same. In other further aspects, the qualitative information region comprises a second dominant background color, where the second dominant background color is different than the first dominant background color. In still other further aspects, the second dominant background color of the first package and the second dominant background color of the second package are different.

In some further aspects, the viewing area further comprises sub-brand indicia disposed at least partially within the product identification region. In other further aspects, at least one of the first package or the second package further comprises a highlight graphic where at least a portion of the sub-brand indicia is disposed within the highlight graphic. In still other further aspects, the highlight graphic and the qualitative information region each have a dominant background color that is the same. In yet other further aspects, the highlight graphic has a shape that is generally ellipsoidal. In still other further aspects, the first package and the second package are each of the same tier level, where the viewing area of the first package comprises a first highlight graphic having a first dominant background color and the viewing area of the second package comprises a second highlight graphic having a second dominant background color, and where the first dominant background color and the second dominant background color are different.

In some further aspects, the viewing area further comprises an emblem graphic, where the emblem graphic includes emblem indicia exhibiting quantitative information. In other further aspects, the photographic indicia relates to the emblem indicia. In still other further aspects, the emblem graphic has a shape that is generally trapezoidal. In yet other further aspects, the product identification region has a first dominant background color and the emblem graphic has a second dominant background color that is the same as the first dominant background color. In still other further aspects, the viewing area further comprises an icon graphic located at least partially within the emblem graphic, where the icon graphic conveys a particular feature of the product contained within the corresponding package.

In some further aspects, the viewing area further comprises a product graphic that exhibits an illustration of the product contained within the corresponding package. In other further aspects, the first package is of a first tier level and the second package is of a second tier level, where the first tier level is a higher tier level than the second tier level, and where the product graphic of the first package exhibits greater visual detail than the product graphic of the second package.

In some further aspects, the viewing area further comprises a caricature graphic that exhibits at least one visual cartoon character, where the at least one visual cartoon character is portrayed in a manner that relates to the respective sub-brand and a corresponding stage of development.

The present invention also discloses an array of personal care product packages, where the array comprises a plurality of packages containing personal care products of a primary brand. In addition, each respective package of the plurality of packages comprises different personal care products. Furthermore, the plurality of packages comprise a visual schema defined by:

a) each package of the plurality of packages having a primary viewing area, the primary viewing area having a top edge, an opposing bottom edge, a first side edge that is located perpendicularly between the top edge and the bottom edge, and a second side edge that is located perpendicularly between the top edge and the bottom edge and is distal to the first side edge;

b) the primary viewing area comprising a product identification region proximate the top edge comprising product identification indicia, a qualitative information region comprising qualitative information indicia, and a photographic region comprising photographic indicia; and c) sub-brand indicia located at least partially within the product identification region.

In addition, the visual schema is repeated for each package of the plurality of packages.

In some further aspects, the product identification region is disposed within the upper third of the viewing area, where the product identification region has a generally plano-convex shape extending from the first side edge to the second side edge, where the product identification region further comprises a top border that is proximate the top edge of the primary viewing area and a bottom border that is convexly curvilinear and is distal to the top border, and where the product identification region comprises a first dominant background color.

In other further aspects, the qualitative information region is disposed within the right third of the viewing area proximate the second side edge and has a second dominant background color that is different than the first dominant background color of the product identification region.

In still other further aspects, the viewing area further comprises an emblem graphic that is proximate the bottom edge and the qualitative information region, where the emblem graphic comprises a third dominant background color that is the same as the first dominant background color of the product identification region, and where the emblem graphic includes quantitative information indicia.

In yet other further aspects, the viewing area further comprises an icon graphic located at least partially within the emblem graphic, where the icon graphic highlights a particular feature of the product contained within a corresponding package.

In still other further aspects, the viewing area further comprises at least one of a product graphic or a caricature graphic, where the product graphic exhibits an illustration of the product contained within a corresponding package, and where the caricature graphic exhibits at least one visual cartoon character portrayed in a manner that relates to the respective product and a corresponding stage of development.

In yet other further aspects, the plurality of packages includes at least one package of a first tier level and at least one package of a second tier level; where the first tier level is defined as being a higher tier level than the second tier level; where the viewing area of the at least one package of the first tier level comprises a highlight graphic; where the highlight graphic comprises a fourth dominant background color that is the same as the second dominant background color of the qualitative information region, and where the highlight graphic has a location such that at least a portion of the sub-brand indicia is present within the highlight graphic.

Numerous other features and advantages of the present invention will appear from the following description. In the description, reference is made to exemplary aspects of the invention. Such embodiments do not represent the full scope of the invention. Reference should therefore be made to the claims herein for interpreting the full scope of the invention. In the interest of brevity and conciseness, any ranges of values set forth in this specification contemplate all values within the range and are to be construed as support for claims reciting any sub-ranges having endpoints which are real number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5.

FIGURES

The foregoing and other features, aspects and advantages of the present invention will become better understood with regard to the following description, appended claims and accompanying drawings where:

Figure 1:
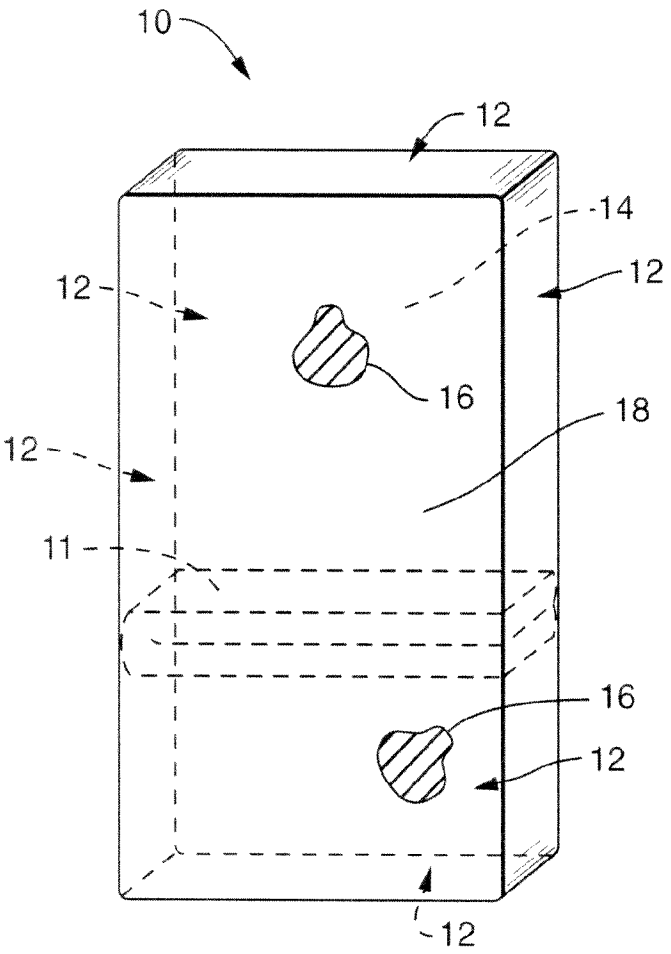
FIG. 1 shows a package containing a personal care product.

Repeated use of reference characters in the present specification and drawings is intended to represent the same or analogous features or elements of the present invention. The drawings are representational and are not necessarily drawn to scale. Certain proportions thereof may be exaggerated, while others may be minimized.

Test Methods

Unless otherwise noted, all tests are performed at a temperature of 23±2° C. and a relative humidity of 50±5%.

Hunter Color Test

For the present application, hue, luminosity and saturation/vividness can be measured as described in the following paragraphs.

The color scale values of the specimen can be measured using the CIE LAB scale. Measurements are made with a Hunter Color reflectance meter. A complete technical description of the system can be found in an article by R. S. Hunter, 'photoelectric color difference Meter', Journal of the Optical Society of America, Vol. 48, pp. 985-95, 1958. Devices specially designed for the measurement of color on the Hunter scales are described in U.S. Pat. No. 3,003,388 to Hunter et al. Additional information can be found at www.hunterlab.com.

Colors can be measured according to an internationally recognized 3-dimensional solid diagram of colors where all colors that are perceived by the human eye are converted into a numerical code. The CIE LAB system is similar to Hunter L, a, b and is based on three dimensions, specifically L*, a*, and b*.

When a color is defined according to this system, L* represents lightness (0=black, 100=white). A shiny white sample will yield an L* value near 100 while a dull black sample will yield an L* value of about 0. a* and b* independently each represent a two color axis, a* representing the axis red/green (+a=red,−a=green), while b* represents the axis yellow/blue (+b=yellow,−b=blue).

A color may be identified by a unique ΔE value (i.e., difference in color from some standard or reference), which is mathematically expressed by the equation:

$$\Delta E^* = [(L^*_X - L^*_Y)^2 + (a^*_X - a^*_Y)^2 + (b^*_X - b^*_Y)^2]^{1/2}$$

where "x" represents the standard or reference sample which may either be a "white" sample or a "colored" sample, e.g., one colored shade may be compared to another colored shade.

Definitions

It should be noted that, when employed in the present disclosure, the terms "comprises," "comprising" and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

The term "disposable" is used herein to describe absorbent articles that are not intended to be laundered or otherwise restored or reused as an absorbent article after a single use.

The term "personal care products" includes, but is not limited to, disposable articles including, but not limited to, diapers, diaper pants, baby wipes, training pants, absorbent underpants, child care pants, swimwear, sanitary napkins, wipes, menstrual pads, menstrual pants, pantiliners, panty shields, interlabials, tampons, adult wipes, breast pads, adult incontinence products, urinary shields, clothing components, bibs, medical gowns, surgical drapes, caps, gloves, face masks, bandages, wound dressings, filters, bed pads, underpads, headbands, wrist bands, absorptive windings, product line extensions (e.g., lotions, powders, etc.), and the like.

The term "product category" refers to a particular line of products where all of the products in the particular line are of the same genre (e.g., all of the products are diapers).

These terms may be defined with additional language in the remaining portions of the specification.

DETAILED DESCRIPTION

The present invention is generally directed to a navigation system which provides the means for a consumer to quickly and easily navigate between various products having different properties and/or benefits within a given brand line. More specifically, one aspect of the invention includes an array of packages containing personal care products (also referred to herein as "products") where the array provides a consumer with the ability to more easily select a desired product across various tiers and/or across various sub-brands within a single primary brand line. The invention also equips a consumer with the ability to visually link a primary brand line of personal care products while visually differentiating a first sub-brand and a second sub-brand that is different than the first sub-brand within the primary brand line. The invention further equips a consumer with the ability to visually link a primary brand line of personal care products while visually differentiating between a lower tier and a higher tier within the primary brand line.

As used herein, the terms "primary brand" and "primary brand line" refer to an entire product lineup which is marketed under a single trade name. For example, in a product lineup comprising diapers, training pants and wipes (along with the various respective product tiers and sub-brands) that are marketed under the trade name HUGGIES, the indicia "HUGGIES" is considered herein to be the primary brand.

As used herein, the term "tier" refers to a first grouping of at least one product within a primary brand which provides at least one additional benefit over a second grouping of at least one product within the same primary brand. Accordingly, the first grouping would be considered as a "higher tier" or "higher tier level" and the second grouping would be considered as a "lower tier" or "lower tier level".

As used herein, the term "sub-brand" refers to variations of products within a particular primary brand. For instance, in the exemplary case of HUGGIES Little Movers and HUGGIES Little Snugglers, the indicia "Little Movers" and "Little Snugglers" are considered to be sub-brands. Two different sub-brands can be within the same product tier level, or can be in different product tier levels.

The invention provides a number of advantages over current packaging arrangements. For example, the invention provides a navigation system that equips a consumer with the ability to quickly navigate the retail shelf to locate a desired product within a primary brand line. The invention can also provide improved clarity of the differences between all products within a single primary brand. The invention can also create stronger visual linkages across various tiers and/or various sub-brands that share similar benefits. The invention can also provide the ability for a consumer to more easily select the next level of product preference, such as based on user development stage, within a primary brand. The invention can also emphasize product differences while maintaining a clear link for navigation within a primary brand. The invention can also provide improved communication to the consumer of variant-specific product benefits within a primary brand. The invention can further provide greater consistency across the entire primary brand line which can deliver easier consumer eye tracking and can help ensure that intended variations are more meaningful.

Packaging is generally known in the art. For example, referring to FIG. 1, an exemplary package 10 is illustrated. The package 10 includes an outer structure 12 that defines an internal space 14. The package 10 also includes at least one product 11 located within the internal space 14. The product 11 can be any suitable personal care product. For example, the product 11 can be a diaper, a training pant, an adult incontinent article, a feminine hygiene product, a wipe and the like.

The outer structures 12, described herein, can be made of any suitable materials. For example, the outer structures 12 can be made of cardboard, card stock, paper, paper board, plastic, polymer film, woven material, non-woven material, metal, or the like, and combinations thereof. The outer structure 12 can define any suitable shape or size, and can include any suitable number of sides. For example, as illustrated in FIG. 1, the outer structure 12 can be a six-sided structure wherein the sides are generally joined together to form a hexahedron. In some aspects, the outer structure 12 may also include handles, gussets, opening features, flaps, folds, lids, lines of weakness, and the like, and combinations thereof.

The outer structure 12 can have a primary viewing area 18 configured to face a consumer on the store shelf. The primary viewing area 18 can comprise any number of various visually perceived elements 16 intended to be visually perceived and comprehended by a consumer with the intent of identifying to the consumer the product 11, as well as particular features and properties of the product 11. The visual elements 16 can be imparted onto the primary viewing area 18 using means well-known in the art, such as painting, flexographic printing, gravure printing, inkjet printing, embossing, or the like, and combinations thereof.

Figure 2:
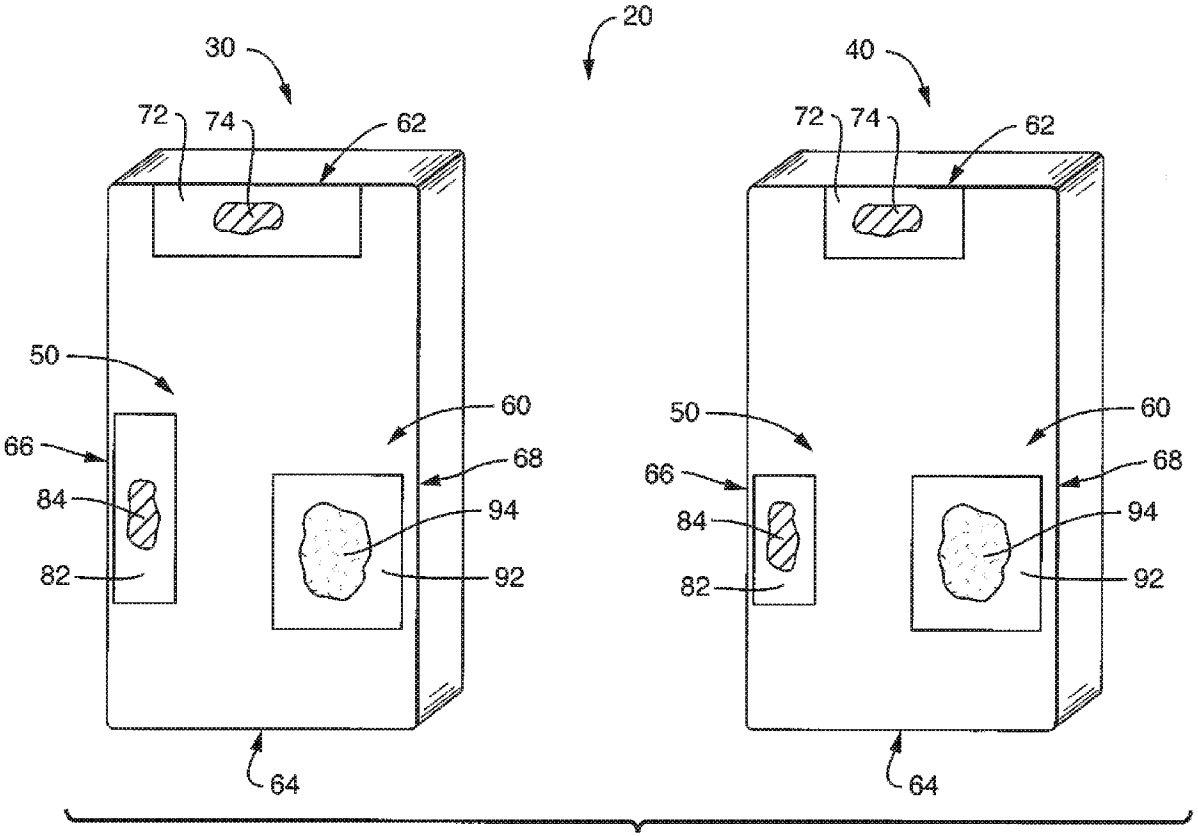
FIG. 2 shows an array of packages of the present invention.

To obtain a better understanding of the present invention, reference is now made to FIG. 2 which shows an array 20 of personal care product packages. In some aspects, the array 20 comprises a first package 30 containing at least one first personal care product (not shown) and a second package 40 containing at least one second personal care product (not shown). The first package 30 and the second package 40 are each of a single primary brand. In some aspects, the first package 30 is of a first sub-brand and the second package 40 is of a second sub-brand that is different than the first sub-brand.

Each package 30,40 in the array further includes a visual schema 50. As used herein, the term "visual schema" refers to a design and arrangement of visually perceived elements imparted onto a packaging surface. In some desirable aspects, the visual schema 50 comprises a primary viewing area 60. The primary viewing area 60 comprises a top edge 62, an opposing bottom edge 64, and two opposing side edges 66,68 located perpendicularly between the top edge 62 and the bottom edge 64. The viewing area 60 also comprises a product identification region 72 proximate the top edge 62 comprising product identification indicia 74. As used herein, the term "product identification indicia" refers to alphanumeric symbols or other symbols that identify or convey the primary brand (e.g., HUGGIES, DEPEND, KOTEX, SCOTT, etc.). The viewing area 60 also comprises a qualitative information region 82 proximate one side edge 66 comprising qualitative information indicia 84. As used herein, the term "qualitative information indicia" refers to alphanumeric symbols or other symbols that identify or convey particular features and/or benefits of the product disposed within a respective package (e.g., "shaped to fit," "flexes to keep up," "fragrance free," "hypoallergenic," etc.). As used herein, qualitative information does not include quantitative information, which is defined below. The viewing area 60 also comprises a photographic region 92 proximate the opposing side edge 68 comprising photographic indicia 94. As used herein, the term "photographic indicia" refers to a photograph of a user donning the product disposed within a respective package and/or performing an activity related to the stage of development of the respective sub-brand, and can also include a background environment. It is understood that while the preceding description and corresponding FIG. 2 disclose that the qualitative information region 82 is proximate side edge 66 and the photographic region 92 is proximate side edge 68, the locations of these regions could be reversed. It is also understood that the product identification region 72, the qualitative information region 82 and the photographic region 92 illustrated in FIG. 2 are not drawn to scale such that in some aspects, regions may or may not fully extend to edges 62,64,66,68; in other aspects at least two of the regions may be in direct contact with each other; and in still other aspects, at least two of the regions may overlap each other. In addition to the preceding description, the visual schema 50 of the invention is repeated for the first package 30 and the second package 40 (i.e. for all packages of the primary brand).

In some aspects, the array of the present invention can include a variety or combination of products, sub-brands and/or tier levels. For example, in one aspect, the first package of the array can be of a first sub-brand and the second package of the array can be of a second sub-brand. In some aspects, the sub-brands can each include a product of the same product category (e.g., a training pant) where the product of the first sub-brand includes at least one variant as compared to the product of the second sub-brand. In addition, different products of the same product category (e.g., a diaper of the first package and a diaper of the second package) can each be of the same tier level, or be of different tier levels. In other aspects, the first sub-brand can include a first product of a first product category (e.g., a feminine pad) and the second sub-brand can include a second product of a different product category (e.g., a wipe). In some versions of this particular aspect, the first product and the second product can be of the same tier level, while in other versions of this aspect, the first product can be of a first tier level and the second product can be of a different tier level. Accordingly, in one particular aspect, the personal care product of the first sub-brand can be a diaper and the personal care product of the second sub-brand can be of a different product category. In another particular aspect, the first sub-brand relates to a first tier level and the second sub-brand relates to a second tier level, where the first tier level and the second tier level are different. It is understood that the limited number of exemplary aspects disclosed above are not limiting, but rather are presented for purposes of brevity, and that numerous other variations of these aspects will be readily apparent to those skilled in the art and are considered to be within the scope of the present invention.

Figure 3:
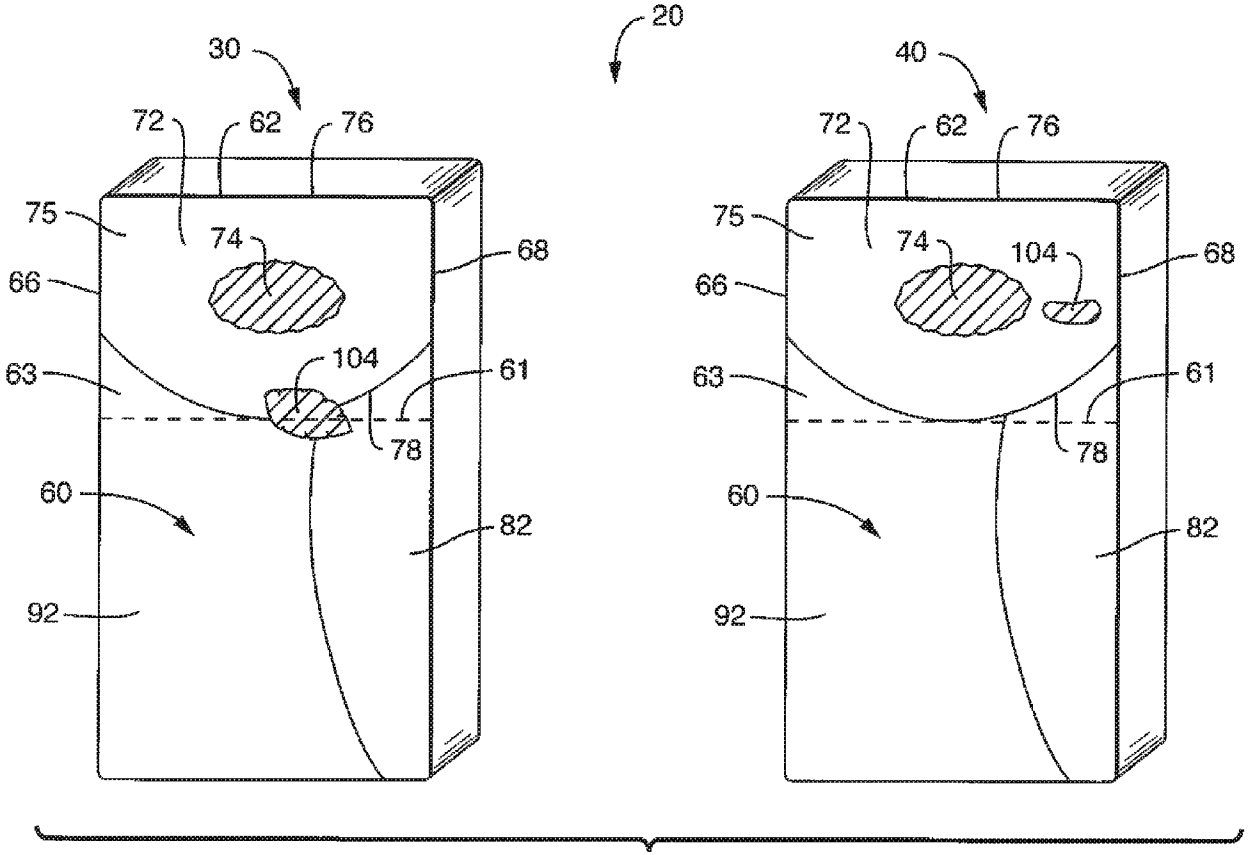
FIG. 3 shows an array of packages of the present invention.

Referring now to FIG. 3, in some aspects, the product identification region 72 can be at least partially located within the upper third 63 of the viewing area 60, as defined by dotted line 61 and the top edge 62. In another version of this aspect, the product identification region 72 extends from one side edge 66 of the viewing area 60 to the opposing side edge 68. In another version of this aspect, the product identification region 72 comprises a top border 76 that is proximate the top edge 62 of the primary viewing area 60. In another version of this aspect, the product identification region 72 has a generally plano-convex shape 75, where the product identification region 72 comprises a bottom border 78 that is convexly curvilinear. An example of a plano-convex shape can be found at http://www.dv.com/article/82460, which is incorporated herein by reference in a manner that is consistent herewith.

In some aspects, the product identification region 72 comprises a first dominant background color, where the first dominant background color of the first package 30 and the first dominant background color of the second package 40 are the same. As used herein, the term "dominant background color" refers to the most prevalent color of a particular visually perceptible element, such as a region or graphic (i.e., the color encompassing the highest percentage of area for the particular visually perceptible element) when viewed with the unaided eye by a consumer having 20/20 vision in lighting at least equal to the illumination of a standard 100 watt incandescent white light bulb at a distance of about 0.075 meters to about 0.91 meters. In other aspects, the qualitative information region 82 comprises a second dominant background color, where the second dominant background color is different than the first dominant background color. In other aspects, the second dominant background color (i.e., the dominant background color of the qualitative information region 82) of the first package and the second dominant background color of the second package are different.

Figure 4:
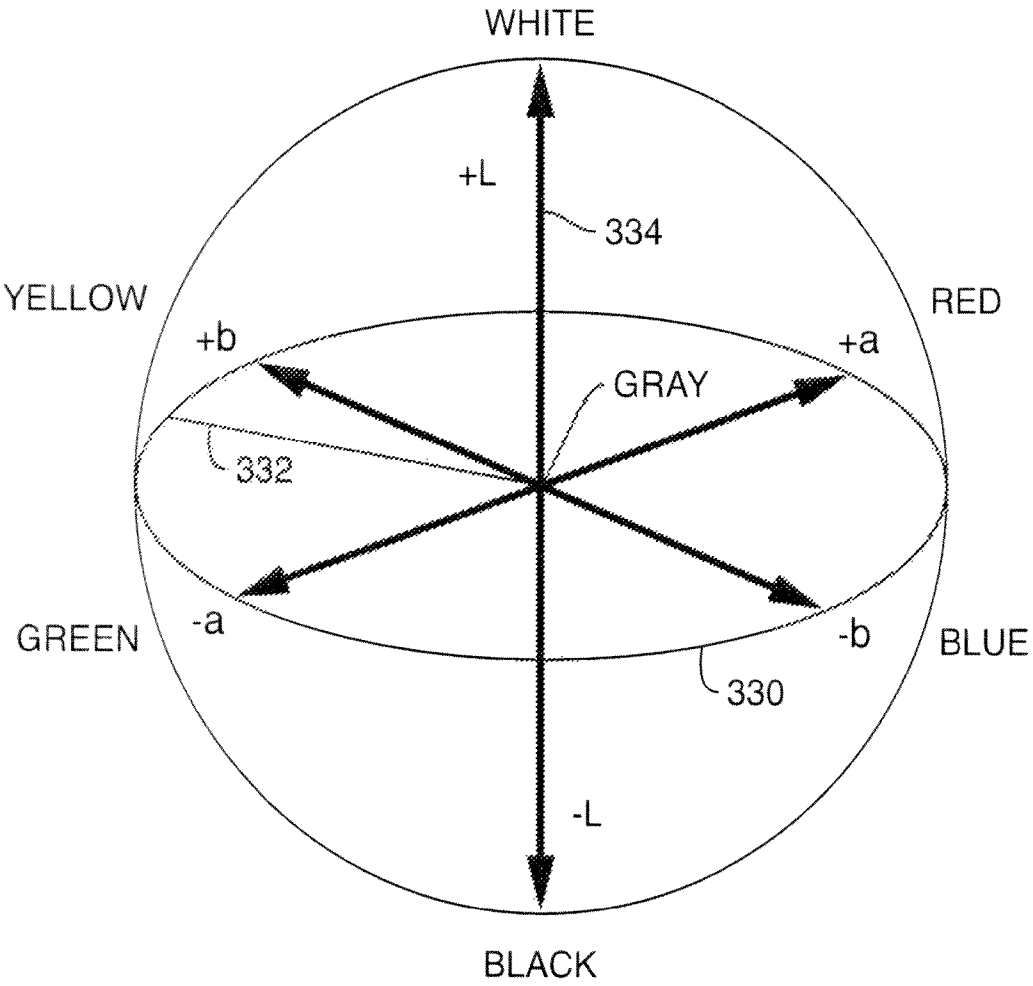
FIG. 4 shows one version of a diagram used to characterize color.

With respect to color, the hue, luminosity and saturation/vividness of a color can be determined by the Hunter Color Test, or equivalent. A color having a particular hue, luminosity and saturation/vividness can be applied to an internationally recognized 3-dimensional solid color chart as would be well-known to those skilled in the art, such as the color chart 310 of FIG. 4, and can be utilized to determine whether a color is the "same," "different" or a "shade." For example, the hue of a particular color can be applied to the color chart 310 along circle 330 having 360 degrees. Thus, two colors are considered to be the same herein when they have first and second respective hues that are 30° apart from each other or less, such as 20° apart from each other or less, or 10° apart from each other or less, when viewed along circle 330. In addition, the value (luminosity) of a color can be applied to the color chart 310 along the z-axis 334 between white and black. Luminosity is measured on a scale from white to black. By way of example only, a luminosity of 100% equates to white while a luminosity of 0% equates to black. Thus, in some aspects, two colors are considered to be the same herein when they also have a luminosity difference of 30% or less, such as 20% or less, or 10% or less of the maximum of the z-axis 334 (using the Polaroid white reference standard). Further, the saturation/vividness (chroma) of a color can be applied to the color chart 310 along the length of the radius (r) 332. Thus, in some aspects, colors are also considered to be the same herein when they have a saturation/vividness difference of 40% or less, such as 25% or less, or 10% or less of maximum of the radius 332. Accordingly, as used herein, colors outside the ranges for colors that the "same," are considered to be "different." In addition, two colors that are the same but that have different values for at least one of the hue, luminosity or saturation/vividness within the ranges for a color being the same is considered to be a "shade." Thus, as applied herein, given two colors, where one color is a shade of the other color, is considered to be the same color.

Additional information with respect to colors and color charts in general can be found at http://www.applepainter-.com, www.hunterlab.com, and http://www.xrite.com/top-_munsell.aspx.

Figure 5:
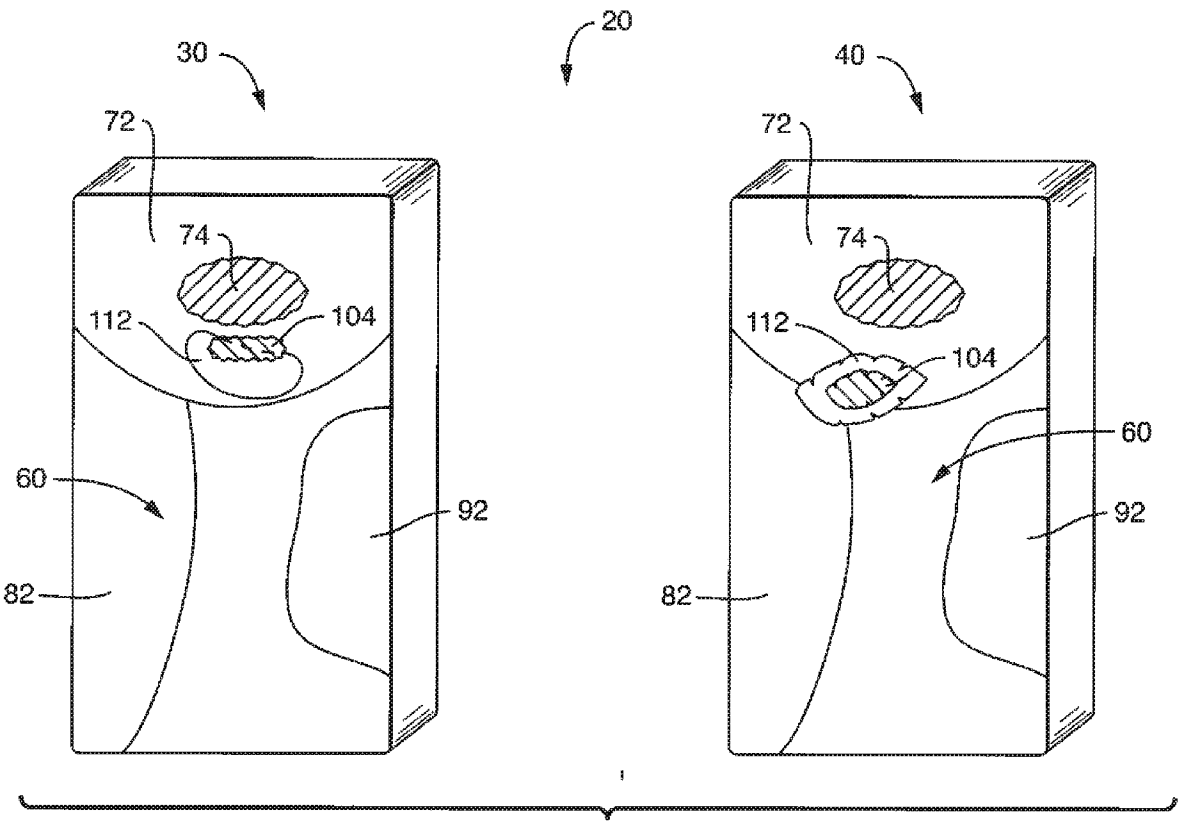
FIG. 5 shows an array of packages of the present invention.
Figure 6A:
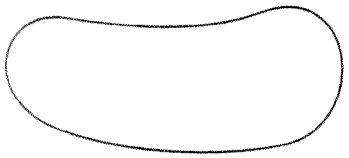
FIGS. 6A-6E show exemplary shapes that are generally ellipsoidal.
Figure 6B:
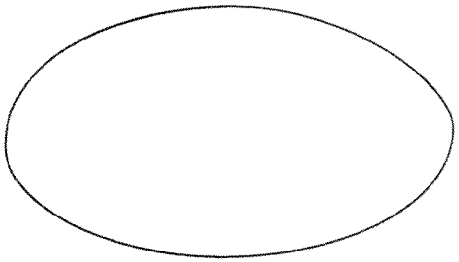
Figure 6C:
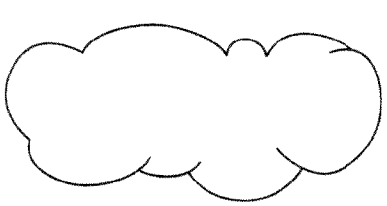
Figure 6D:
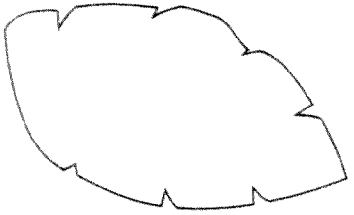
Figure 6E:
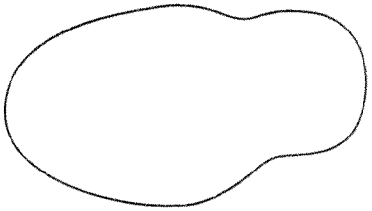

Referring now to FIGS. 3 and 5, in some aspects, the viewing area 60 further comprises sub-brand indicia 104 disposed at least partially within the product identification region 72. In further versions of this aspect, at least one of the first package 30 or the second package 40 further comprises a highlight graphic 112 wherein at least a portion of the sub-brand indicia 104 is disposed within the highlight graphic 112. In other versions of this aspect, the highlight graphic 112 and the qualitative information region 72 each have a dominant background color that is the same. In one particular non-limiting version of this aspect, the highlight graphic 112 has a shape that is generally ellipsoidal, although it need not be. As used herein, the term "generally ellipsoidal" refers to a shape that has an overall perimeter that resembles an ellipse shape. Several examples of shapes that are considered herein as being generally ellipsoidal are illustrated in FIGS. 6A-6E. It is understood that the exemplary shapes illustrated in FIGS. 6A-6E are not limiting, but rather are presented for purposes of brevity, and that other variations of generally ellipsoidal shapes will be readily apparent to those skilled in the art and are considered to be within the scope of the present invention. In addition, shapes other than those that are generally ellipsoidal are also within the scope of the invention, including but not limited to circular, trapezoidal, triangular, quadrilateral, pentagonal, hexagonal, heptagonal, octagonal, nonagonal, decagonal, other polygonals, as well as heart-shaped, maple leaf-shaped, wipe-shaped, pumpkin-shaped, Christmas tree-shaped, random-shaped, and the like.

Figure 7:
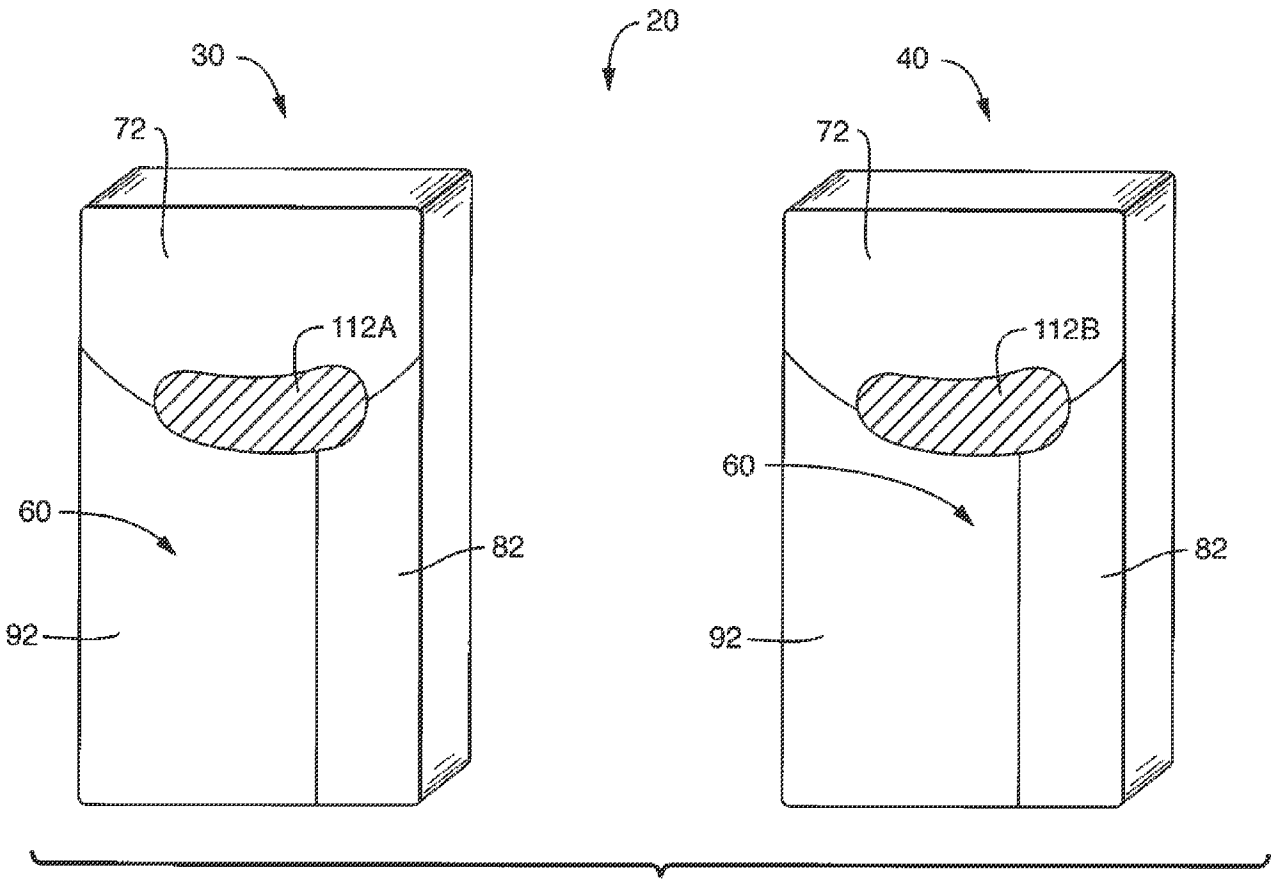
FIG. 7 shows an array of packages of the present invention.

Referring now to FIG. 7, in some aspects, the first package 30 and the second package 40 are each of the same tier level, where the viewing area 60 of the first package 30 comprises a first highlight graphic 112A having a first dominant background color and the viewing area 60 of the second package 40 comprises a second highlight graphic 112B having a second dominant background color, where the first dominant background color and the second dominant background color are different.

Figure 8:
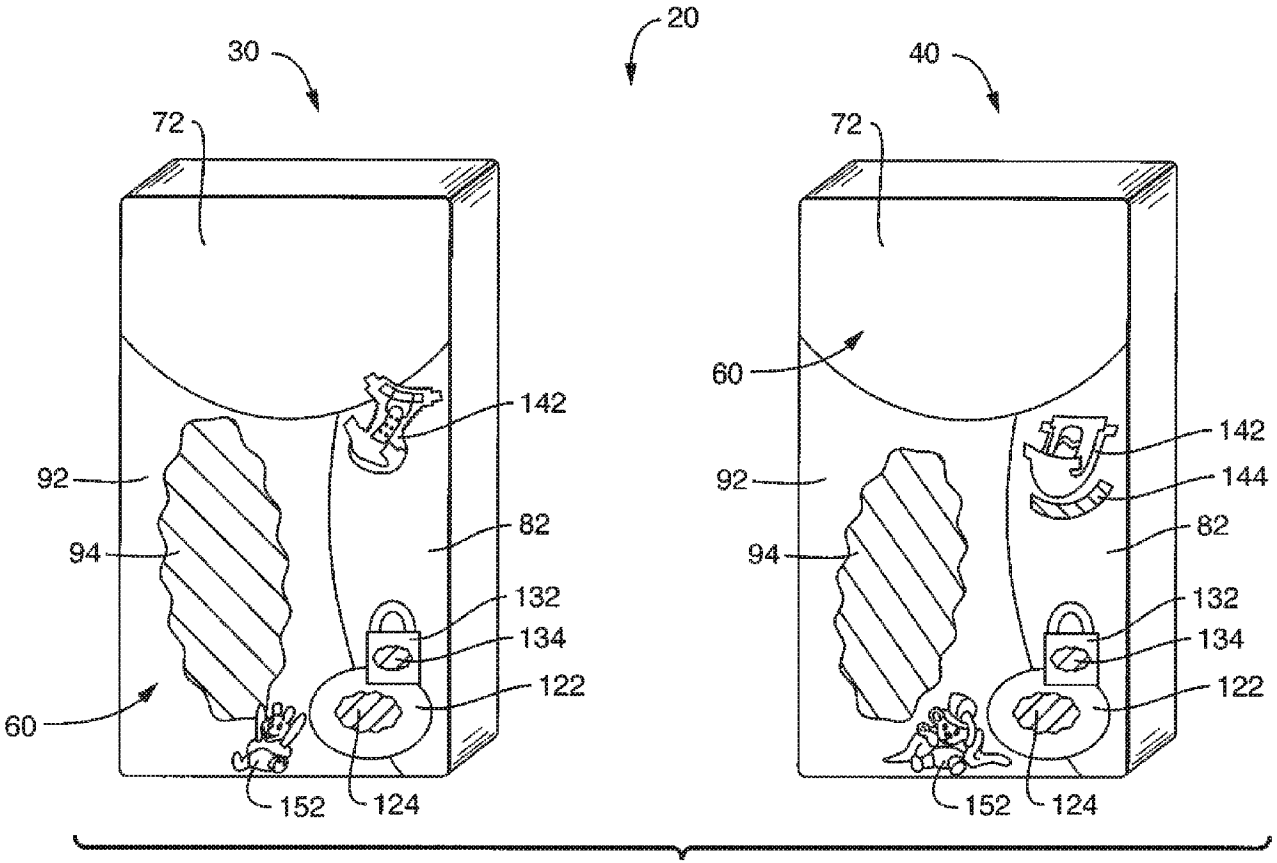
FIG. 8 shows an array of packages of the present invention.
Figure 9A:
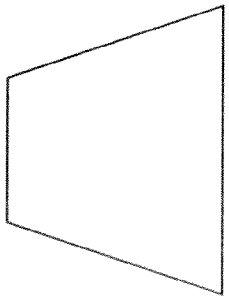
FIGS. 9A-9E show exemplary shapes that are generally trapezoidal.
Figure 9B:
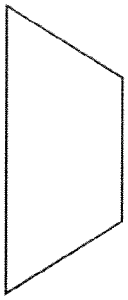
Figure 9C:
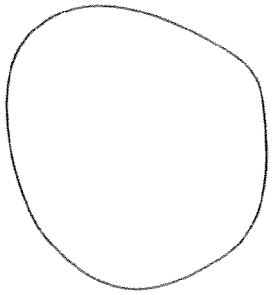
Figure 9D:
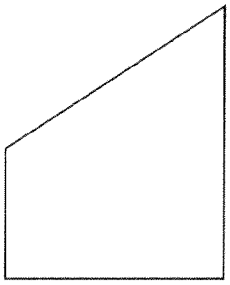
Figure 9E:
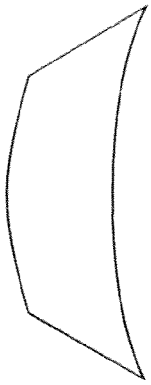

Referring now to FIG. 8, in some aspects, the viewing area 60 further comprises an emblem graphic 122, and wherein the emblem graphic 122 that includes emblem indicia 124 exhibiting quantitative information. As used herein, the term "quantitative information" refers to alphanumeric symbols or other symbols that identify or convey particular physical data pertaining to the contents of a respective package (e.g., development stage, user weight range, product count, etc.). As used herein, quantitative information does not include qualitative information, which is defined above. In some versions of this aspect, the photographic indicia 94 of the photographic region 92 relates to the emblem indicia 124. In one particular version of this aspect, the emblem graphic 124 has a shape that is generally trapezoidal. As used herein, the term "generally trapezoidal" refers to a shape that has an overall perimeter that resembles a trapezoid shape. Several examples of shapes that are considered herein as being generally trapezoidal are illustrated in FIGS. 9A-9E. It is understood that the exemplary shapes illustrated in FIGS. 9A-9E are not limiting, but rather are presented for purposes of brevity, and that other variations of generally ellipsoidal shapes will be readily apparent to those skilled in the art and are considered to be within the scope of the present invention. In addition, shapes other than those that are generally trapezoidal are also within the scope of the invention, including circular, ellipsoidal, triangular, quadrilateral, pentagonal, hexagonal, heptagonal, octagonal, nonagonal, decagonal, other polygonals, as well as heart-shaped, leaf-shaped, wipe-shaped, pumpkin-shaped, Christmas tree-shaped, random-shaped, and the like. Returning now to FIG. 8, in yet other versions of this aspect, the product identification region 72 has a first dominant background color and the emblem graphic 122 has a second dominant background color that is the same as the first dominant background color of the product identification region 72. In still other versions of this aspect, the viewing area 60 further comprises an icon graphic 132 located at least partially within the emblem graphic 122, where the icon graphic 132 conveys a particular feature of the product contained within a corresponding package.

In some aspects, the viewing area 60 further comprises a product graphic 142 that exhibits an illustration of the product contained within the corresponding package. In some aspects, the product graphic can further include product graphic indicia 144. In other versions of this aspect, the first package is of a first tier level and the second package is of a second tier level, where the first tier level is a higher tier level than the second tier level, and where the product graphic of the first package exhibits greater visual detail than the product graphic of the second package. As used herein, the term "greater visual detail" refers to a visually perceptible graphic which has enhanced properties (e.g., features, colors, image size, vividness, patterns, style, font, line weight, etc.) as compared to another visually perceptible graphic.

Still referring to FIG. 8, in some aspects, the viewing area 60 further comprises a caricature graphic 152 that exhibits at least one visual cartoon character. In further versions of this aspect, the at least one visual cartoon character 152 can be portrayed in a manner that relates to the respective sub-brand and a corresponding stage of development.

Figure 10:
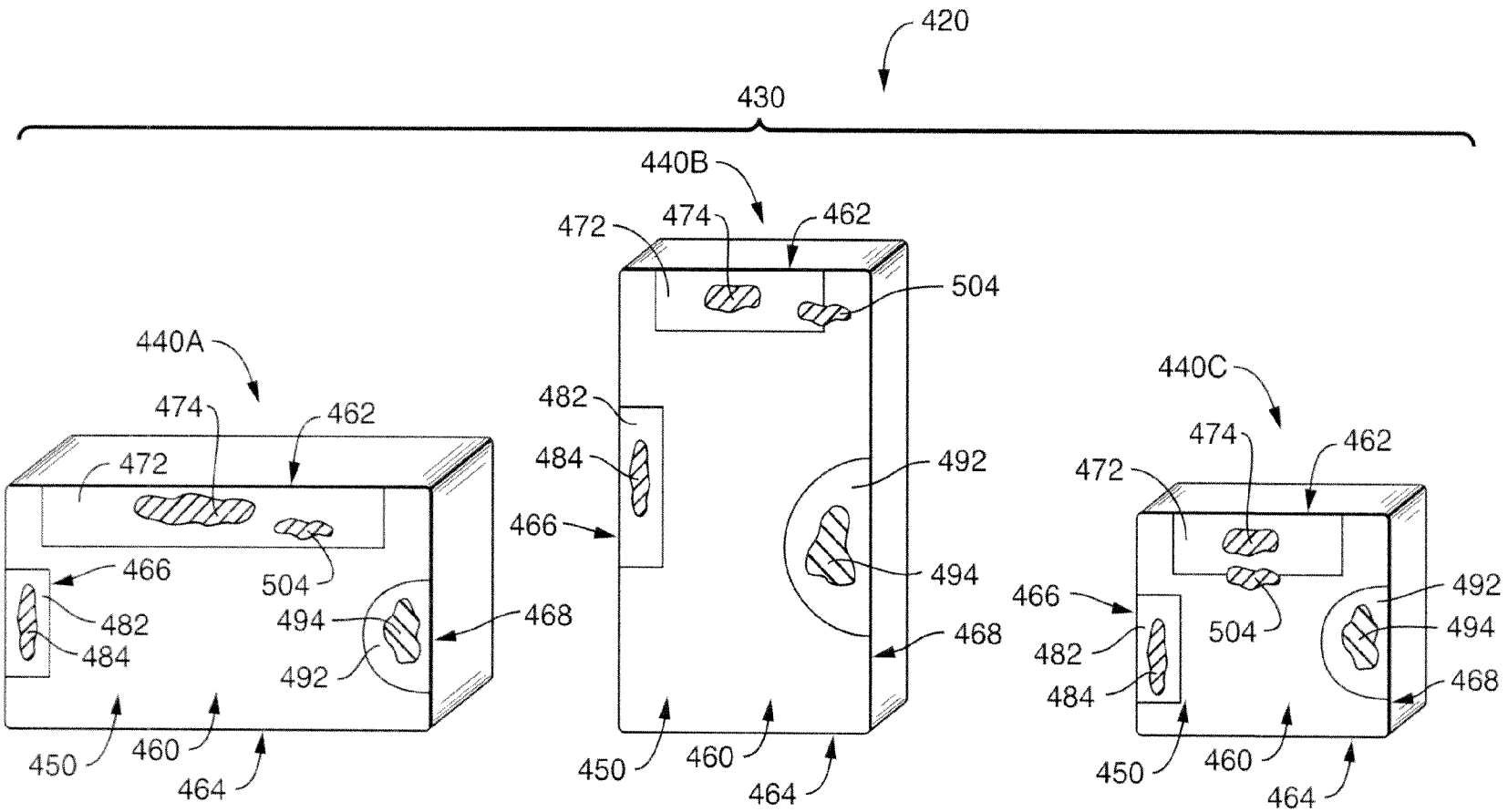
FIG. 10 shows an array of packages of the present invention.

Referring now to FIG. 10, in another version of the present invention, an array of personal care product packages 420 comprises a plurality of packages 430 containing personal care products (not shown) of a primary brand. While FIG. 10 illustrates an array of three packages, as used herein, the term "plurality of packages" refers to an array having at least two different packages, such as at least five different packages, or at least 10 different packages, or at least 25 different packages, or more. In this particular aspect of the invention, each respective package of the plurality of packages comprises a different personal care product. As used herein, the term "different personal care product" refers to products of the same product category (e.g., diapers), each having at least one variant as compared to the others, as well as to products of different product categories (e.g., a diaper, a wipe, a training pant, etc.). In addition, the plurality of packages 430 comprises a visual schema 450 defined by the following:

a) Each package 440A,440B,440C of the plurality of packages 430 has a primary viewing area 460, the primary viewing area 460 having a top edge 462, an opposing bottom edge 464, a first side edge 466 that is located perpendicularly between the top edge 462 and the bottom edge 464, and a second side edge 468 that is located perpendicularly between the top edge 462 and the bottom edge 464 and is distal to the first side edge 466;

b) The primary viewing area 460 comprises a product identification region 472 proximate the top edge 462 comprising product identification indicia 474, a qualitative information region 482 comprising qualitative information indicia 484, and a photographic region 492 comprising photographic indicia 494; and c) The presence of sub-brand indicia 504 located at least partially within the product identification region 472.

In addition, the visual schema 450 is repeated for each package 440A,440B,440C of the plurality of packages 430.

Figure 11:
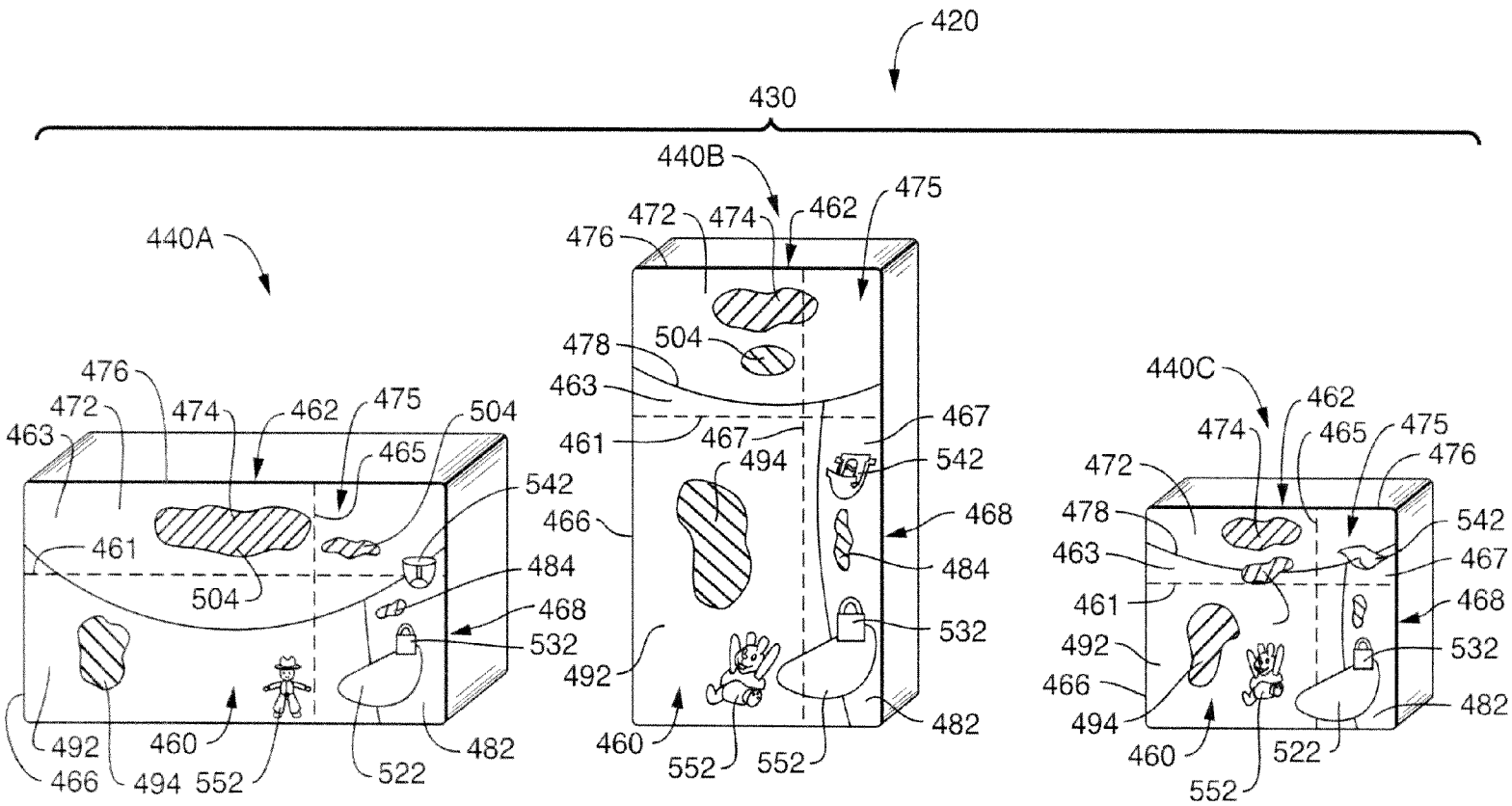
FIG. 11 shows an array of packages of the present invention.

Referring now to FIG. 11, in some aspects of this embodiment, the product identification region 472 is disposed within the upper third 463 of the viewing area 460, as defined by dotted line 461 and the top edge 462. In further versions of this aspect, the product identification region 472 has a generally plano-convex shape 475 extending from the first side edge 466 to the second side edge 468. In further versions of this aspect, the product identification region 472 further comprises a top border 476 that is proximate the top edge 462 of the primary viewing area 460 and a bottom border 478 that is convexly curvilinear and is distal to the top border 462. In further versions of this aspect, the product identification region 472 comprises a first dominant background color.

In some aspects, the qualitative information region 482 is disposed within the right third 467 of the viewing area 460 as defined by dotted line 465 and the second and is proximate the second side edge 468. In further versions of this aspect, the qualitative information region 482 has a second dominant background color that is different than the first dominant background color of the product identification region 472.

In some aspects, the viewing area 460 further comprises an emblem graphic 522 that is proximate the bottom edge 464 and the qualitative information region 472. In further versions of this aspect, the emblem graphic 522 comprises a third dominant background color that is the same as the first dominant background color of the product identification region 472. In further versions of this aspect, the emblem graphic 522 includes quantitative information indicia 474.

In some aspects, the viewing area 460 further comprises an icon graphic 532 located at least partially within the emblem graphic 522. In further versions of this aspect, the icon graphic 532 highlights a particular feature of the product contained within a corresponding package.

In some aspects, the viewing area 460 further comprises at least one of a product graphic 542 or a caricature graphic 552. In further versions of this aspect, the product graphic 542 exhibits an illustration of the product contained within a corresponding package. In further versions of this aspect, the caricature graphic 552 exhibits at least one visual cartoon character portrayed in a manner that relates to the respective product and a corresponding stage of development.

Figure 12:
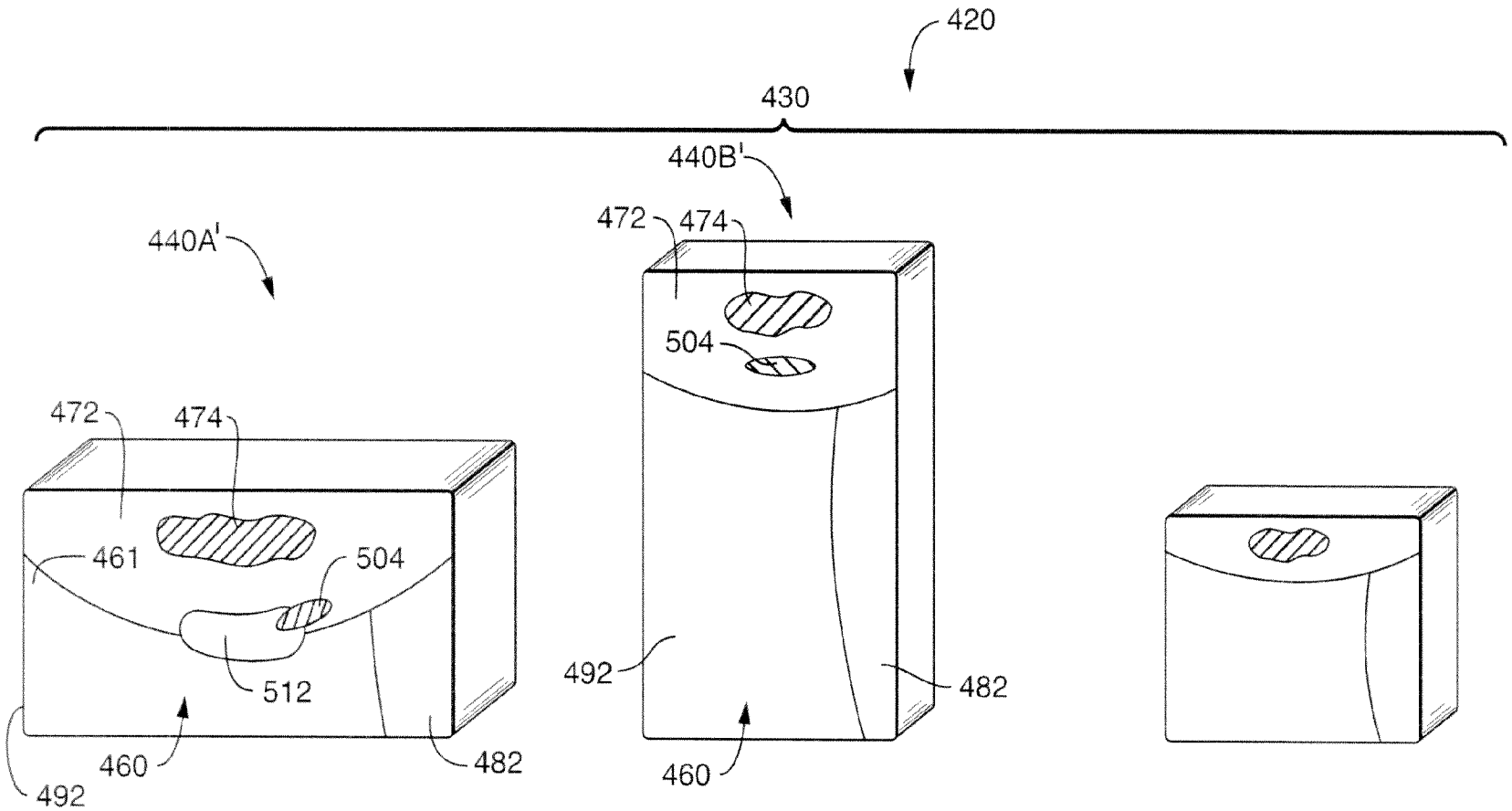
FIG. 12 shows an array of packages of the present invention.

Referring now to FIG. 12, in some aspects, the plurality of packages 430 includes at least one package 440A' of a first tier level and at least one package 440B' of a second tier level, where the first tier level is defined as being a higher tier level than the second tier level. In further versions of this aspect, the viewing area 460 of the at least one package of the first tier level 440A'comprises a highlight graphic 512. In further versions of this aspect, the highlight graphic 512 comprises a fourth dominant background color that is the same as the second dominant background color of the qualitative information region 482. In further versions of this aspect, the highlight graphic 512 has a location such that at least a portion of the sub-brand indicia 504 is present within the highlight graphic 512.

It will be appreciated that details of the foregoing examples, given for purposes of illustration, are not to be construed as limiting the scope of this invention. Although only a few exemplary embodiments of this invention have been described in detail above, those skilled in the art will readily appreciate that many modifications are possible in the examples without materially departing from the novel teachings and advantages of this invention. For example, features described in relation to one example may be incorporated into any other example of the invention.

Accordingly, all such modifications are intended to be included within the scope of this invention, which is defined in the following claims and all equivalents thereto. Further, it is recognized that many embodiments may be conceived that do not achieve all of the advantages of some embodiments, particularly of the desirable embodiments, yet the absence of a particular advantage shall not be construed to necessarily mean that such an embodiment is outside the scope of the present invention. As various changes could be made in the above constructions without departing from the scope of the invention, it is intended that all matter contained in the above description shall be interpreted as illustrative and not in a limiting sense.

What is claimed is:

1. An array of personal care product packages, the array comprising:

a plurality of packages containing personal care products of a primary brand;

wherein each respective package of the plurality of packages comprises different personal care products; and wherein the plurality of packages comprise a visual schema defined by:

a) each package of the plurality of packages having a primary viewing area, the primary viewing area having a top edge, an opposing bottom edge, a first side edge that is located perpendicularly between the top edge and the bottom edge, and a second side edge that is located perpendicularly between the top edge and the bottom edge and is distal to the first side edge;

b) the primary viewing area comprising a product identification region proximate the top edge comprising product identification indicia, a qualitative information region comprising qualitative information indicia, and a photographic region comprising photographic indicia; and c) sub-brand indicia located at least partially within the product identification region; and wherein the product identification region is disposed within the upper third of the viewing area, wherein the product identification region has a generally plano-convex shape extending from the first side edge to the second side edge, wherein the product identification region further comprises a top border that is proximate the top edge of the primary viewing area and a bottom border that is convexly curvilinear and is distal to the top border, wherein the product identification region comprises a first dominant background color, wherein the qualitative information region is disposed within the right third of the viewing area proximate the second side edge and has a second dominant background color that is different than the first dominant background color, wherein the viewing area further comprises an emblem graphic that is proximate the bottom edge and the qualitative information region, wherein the emblem graphic comprises a third dominant background color that is the same as the first dominant background color, and wherein the emblem graphic includes quantitative information indicia, and wherein the visual schema is repeated for each package of the plurality of packages.

2. The array of claim 1 wherein the viewing area further comprises an icon graphic located at least partially within the emblem graphic, wherein the icon graphic highlights a particular feature of the product contained within a corresponding package.

3. The array of claim 1 wherein the viewing area further comprises at least one of a product graphic or a caricature graphic, wherein the product graphic exhibits an illustration of the product contained within a corresponding package, and wherein the caricature graphic exhibits at least one visual cartoon character portrayed in a manner that relates to the respective product and a corresponding stage of development.

4. The array of claim 1 wherein the plurality of packages includes at least one package of a first tier level and at least one package of a second tier level; wherein the first tier level is defined as being a higher tier level than the second tier level; wherein the viewing area of the at least one package of the first tier level comprises a highlight graphic; wherein the highlight graphic comprises a fourth dominant background color that is the same as the second dominant background color, and wherein the highlight graphic has a location such that at least a portion of the sub-brand indicia is present within the highlight graphic.

* * * * *